US007784209B2

(12) United States Patent
Greer

(10) Patent No.: US 7,784,209 B2
(45) Date of Patent: Aug. 31, 2010

(54) LAMINATE WEB WRISTBAND

(75) Inventor: Mark Greer, O'Fallon, MO (US)

(73) Assignee: Laser Band, LLC, St. Louis, MO (US)

( * ) Notice: Subject to any disclaimer, the term of this patent is extended or adjusted under 35 U.S.C. 154(b) by 80 days.

(21) Appl. No.: 11/553,891

(22) Filed: Oct. 27, 2006

(65) Prior Publication Data

US 2008/0098636 A1 May 1, 2008

(51) Int. Cl.
*A44C 5/00* (2006.01)

(52) U.S. Cl. ..... 40/633

(58) Field of Classification Search ..... 40/633, 40/586; 283/75, 900
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,383,335 | A | 7/1921 | Penksa |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Francois |
| 2,641,074 | A | 6/1953 | Richmond |
| 2,687,978 | A | 8/1954 | Vogt |
| 3,197,899 | A | 8/1965 | Twentier |
| 3,402,808 | A | 9/1968 | Yannuzzi |
| 3,517,802 | A | 6/1970 | Petrie |
| 3,660,916 | A | 5/1972 | McDermott et al. |
| 3,854,229 | A | 12/1974 | Morgan |
| 4,004,362 | A | 1/1977 | Barbieri |

(Continued)

FOREIGN PATENT DOCUMENTS

| | | |
|---|---|---|
| EP | 1039431 | 9/2000 |

(Continued)

OTHER PUBLICATIONS

ID Warehouse (http://web.archive.org/web/20050131235601/http://idwarehouse.com/) Jan. 31, 2005. p. 1: WB1908, Stock Vinyl Wristband.

(Continued)

*Primary Examiner*—Joanne Silbermann
(74) *Attorney, Agent, or Firm*—Thompson Coburn LLP

(57) ABSTRACT

A composite web comprised of a base or first full width web is adhered to a second, partial width web with both webs being made of a generally transparent, lightweight laminate material. A layer of adhesive, covered by a protective release coated liner of partial width is applied to the second laminate web, and between the first and second laminate webs. At the other side of the web another layer of adhesive is applied along with another protective liner. A die cut in the composite web defines the outline of a plurality of adjacent self laminating wristbands which may be separated from the web by tearing along the die cut. A second die cut forms a slot in each wristband carrier to be used along with the strap end to fasten the wristband to a wearer, in cinch and strap manner. A continuous web includes a continuous number of wristband carriers with cinch attachment although a page or sheet may be cut to any desired shape or number of wristbands.

19 Claims, 4 Drawing Sheets

U.S. PATENT DOCUMENTS 4,078,324 A 3/1978 Wiebe
4,179,833 A 12/1979 Knodel
4,226,036 A 10/1980 Krug
4,233,715 A 11/1980 McDermott
4,565,731 A 1/1986 Komatsu et al.
4,612,718 A 9/1986 Golub et al.
4,627,994 A 12/1986 Welsch
4,630,384 A 12/1986 Breen
4,682,431 A 7/1987 Kowalchuk
4,696,843 A 9/1987 Schmidt
4,783,917 A * 11/1988 Smith et al. ..... 40/633
4,829,604 A 5/1989 Allen et al.
4,854,610 A 8/1989 Kwiatek
4,855,277 A 8/1989 Walter
4,914,843 A * 4/1990 DeWoskin ..... 40/633
4,941,210 A 7/1990 Konucik
4,956,931 A 9/1990 Selke
4,978,144 A 12/1990 Schmidt et al.
4,991,337 A 2/1991 Solon
RE33,616 E 6/1991 Welsch
5,026,084 A 6/1991 Pasfield
5,045,426 A 9/1991 Maierson et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,351,993 A 10/1994 Wright
5,370,420 A 12/1994 Khatib et al.
5,381,617 A 1/1995 Schwartztol et al.
5,383,686 A 1/1995 Laurash
5,418,026 A 5/1995 Dronzek, Jr. et al.
5,427,416 A 6/1995 Birch
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,581,924 A * 12/1996 Peterson ..... 40/633
5,586,788 A 12/1996 Laurash
5,595,404 A 1/1997 Skees
5,598,970 A 2/1997 Mudry et al.
5,601,222 A 2/1997 Haddad
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
5,765,885 A 6/1998 Netto
5,785,354 A 7/1998 Haas
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
6,053,535 A 4/2000 Washburn et al.
6,055,756 A 5/2000 Aoki
6,067,739 A 5/2000 Riley
6,071,585 A 6/2000 Roth
6,092,321 A 7/2000 Cheng et al.
6,108,876 A 8/2000 Hubbert
6,155,476 A 12/2000 Fabel
6,155,603 A 12/2000 Fox
6,159,570 A 12/2000 Ulrich et al.
6,199,730 B1 3/2001 Chisolm
6,303,539 B1 10/2001 Kosarew
6,331,018 B1 12/2001 Roth et al.
6,343,819 B1 2/2002 Shiozaki
6,361,078 B1 3/2002 Chess
6,409,871 B1 6/2002 Washburn et al.
6,438,881 B1 8/2002 Riley
6,510,634 B1 1/2003 Riley
6,517,921 B2 2/2003 Ulrich et al.
6,611,962 B2 9/2003 Redwood et al.
6,641,048 B1 11/2003 Schintz et al.
6,685,228 B2 2/2004 Riley
6,748,687 B2 6/2004 Riley
6,807,680 B2 10/2004 Sloot
6,836,215 B1 12/2004 Laurash et al.
6,863,311 B2 3/2005 Riley
7,017,293 B2 3/2006 Riley
7,017,294 B2 * 3/2006 Riley ..... 40/633
7,047,682 B2 5/2006 Riley
7,222,448 B2 5/2007 Riley
7,240,446 B2 * 7/2007 Bekker ..... 40/633
7,523,576 B1 4/2009 Petty
2002/0176973 A1 11/2002 Keiser
2003/0001381 A1 1/2003 Riley
2003/0003249 A1 1/2003 Benim et al.
2003/0011190 A1 1/2003 Ryan
2004/0068906 A1 4/2004 Riley
2004/0128892 A1 7/2004 Valenti
2004/0244251 A1 12/2004 Riley
2005/0091896 A1 5/2005 Kotik et al.
2005/0108912 A1 5/2005 Bekker
2005/0279001 A1 12/2005 Riley
2005/0281989 A1 12/2005 Finger
2006/0230661 A1 10/2006 Bekker
2006/0236578 A1 10/2006 Saint et al.
2006/0242875 A1 11/2006 Wilson et al.
2006/0261958 A1 11/2006 Klein
2007/0089342 A1 4/2007 Jain et al.
2007/0120358 A1 5/2007 Waggoner et al.
2007/0243361 A1 10/2007 Riley et al.
2008/0098636 A1 5/2008 Greer
2009/0094872 A1 4/2009 Ali et al.
2009/0193701 A1 8/2009 Greer
2009/0277061 A1 11/2009 Jain et al.
2009/0282717 A1 11/2009 Jain et al.

FOREIGN PATENT DOCUMENTS

FR 2806594 A 9/2001
GB 960859 6/1964
GB 2045718 11/1980
GB 2160492 12/1985
GB 2228915 A 9/1990
JP 5-61777 8/1993
JP 08-190350 7/1996
JP 3032299 12/1996
JP 10-207374 8/1998
JP 2002351321 A 12/2002
JP 2003066849 3/2003
JP 2003157010 5/2003
JP 2003164307 6/2003
JP 2006039209 2/2006
WO 9502877 1/1995
WO WO 96/12618 5/1996
WO WO 98/23081 5/1998
WO WO 99/18817 4/1999
WO WO 02/39412 5/2002
WO WO 03/003331 1/2003
WO WO 2004/028826 4/2004
WO WO 2006/007356 6/2005

| | | | |
|---|---|---|---|
| WO | WO 2005/064574 | | 7/2005 |
| WO | 2007/021375 | | 2/2007 |
| WO | 2007/133906 | | 11/2007 |
| WO | 2009099787 | A1 | 8/2009 |
| WO | 2009/137195 | | 11/2009 |

OTHER PUBLICATIONS

Office Action for AU Application No. 2008202215 dated Dec. 15, 2009.
Office Action for CN Application 03825215.5 dated Jan. 8, 2010.
Office Action for EP Application 07842813.3 dated Feb. 4, 2010.
International Search Report for PCT/US2009/031979 dated Mar. 9, 2009.
International Preliminary Report on Patentability (Chapter II) for PCT/US2008/059616 dated Jul. 14, 2009.
International Search Report for PCT/US2009/039183 dated Jun. 25, 2009.
Office Action for AU Application 2006280450 dated Sep. 14, 2009.
Office Action for CN Application 200580019868.5 dated Sep. 4, 2009.
Office Action for EP Application 03773060.3 dated Aug. 11, 2009.
International Preliminary Report on Patentability (Chapter I) for PCT/US2008/064972 dated Dec. 1, 2009.
Avery Dennison DuraCard™.
Avery® Laminated Identification Cards #5361.
Brochure entitled: "Color-Bar® Click Strip™ Label System"; Smead Manufacturing Company; Date Unknown; Form No. SSS-CS-00.
Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions™; Date Unknown; Form No. SSS-RC1-00.
Sample of Standard Register Labels.
Standard Register, *P.S. Magazine*, Fall 1998, Dayton, Ohio.
Gretchen Berry, "Wrist Watch," *Advance for Healthcare Information Professionals*, Feb. 15, 1999.
Sample of Standard Register Label.
"Yes, Sir, That's My Baby!," *Material Management in Health Care*, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.

* cited by examiner

LAMINATE WEB WRISTBAND

CROSS-REFERENCE TO RELATED APPLICATIONS

This application is related to two other applications being filed concurrently herewith. They are "Wristband with Snap Closure and Patient ID Label" having Ser. No. 11/553,872; and "Wristband with Contoured Comfort Sides" having Ser. No. 11/553,873; both of even filing date herewith and the disclosures of which are incorporated herein by reference.

BACKGROUND AND SUMMARY OF THE INVENTION

Wristbands for use in admitting and identifying patients for both in patient and out patient care are routinely used in the medical community today. The assignee hereof owns a number of patents disclosing and claiming various inventive wristbands suited to this medical field application, and which have experienced great commercial success. Examples of these include U.S. Pat. Nos. 5,933,993; 6,000,160; 6,067,739; 6,438,881; 6,510,634; 6,748,687; 7,047,682; 7,017,293; and 7,017,294, the disclosures of which are incorporated herein by reference. These patented wristbands have been made and sold by the millions. Some are sized for use on adults and others are sized for use on infants and even newborns having the smallest of wrists. In fact, typically the wristbands are attached around a baby's ankles, so as used herein the term "wrist" should be understood to include any person's limb and "wristband" should be understood to include a band intended to be placed around any person's limb. The wristband designs shown in the "7" million numbered patents include a shorter length face ply imaging area die cut into a face stock ply and a laminating ply having a clamshell for enclosing the imaging area along with an integrally formed strap and cinch slot attachment arrangement for securing the wristband about a wearer's wrist. The embodiments shown in these patents are for multi-ply construction, with a face ply preferably made from paper stock and a laminating ply adhered thereto generally in full or partial sheet size and with the wristband elements die cut therein. While this construction has been very successful, and millions of wristbands of this construction have been sold and are continuing to be sold, the assignee continually endeavors to improve on its designs and develop alternate constructions, especially when cost savings can be achieved.

As an alternative construction to that shown in the assignee's prior patents, the inventor herein has succeeded in designing and developing a simplified construction of a composite laminate web into which a plurality of self laminating wristband carriers is die cut from relatively thin laminate, with layers of adhesive protected with releasable liners so that individual carriers may be separated from the composite web and used to self laminate separately formed labels therein. As continuous webs of thin laminate material are welded together in a continuous process, with adhesive and liners also being applied in a continuous process, the costs are anticipated to be greatly reduced over the multi-ply construction previously disclosed and commercialized. Furthermore, providing the carriers separately adapts them for use with labels which themselves can be separately formed in continuous rolls, or having other desired construction features. This allows a user to separately choose and utilize labels of different design, with perhaps having different color, information, medical condition flags, or other features built into or added to the labels.

While it is known in the prior art to form self laminating wristbands in continuous composite web format, the prior art wristband design known to the inventor to have been so made incorporates a snap closure at an end of the wristband requiring an increased length as well as a series of holes to be punched in the strap to provide an adjustable length. This prior art construction did not include the cinch slot and strap attachment design of the present invention. Use of the snap closure device further required two plastic inserts (male and female) to be assembled to each carrier in the web, while the inventors cinch slot and strap attachment design eliminates these assembly steps. Furthermore, the cinch slot and strap attachment provides infinite adjustability instead of the fixed lengths provided by the fixed strap hole positions. Also, perhaps because of all the holes punched in the strap, the vinyl material used to make this prior art design was of heavier construction than that of the present invention. For example, the thickness of the prior art composite web is 12 mil while that of the present invention is merely a nominal 2 mil. This construction further improves the comfort for a wearer of the wristband due in part to the wristband being lighter and more flexible as well.

While some of the advantages and features of the present invention have been explained above, a fuller understanding may be attained by referring to the drawings and description of the preferred embodiment below.

DETAILED DESCRIPTION OF THE PREFERRED EMBODIMENT

Figure 1:
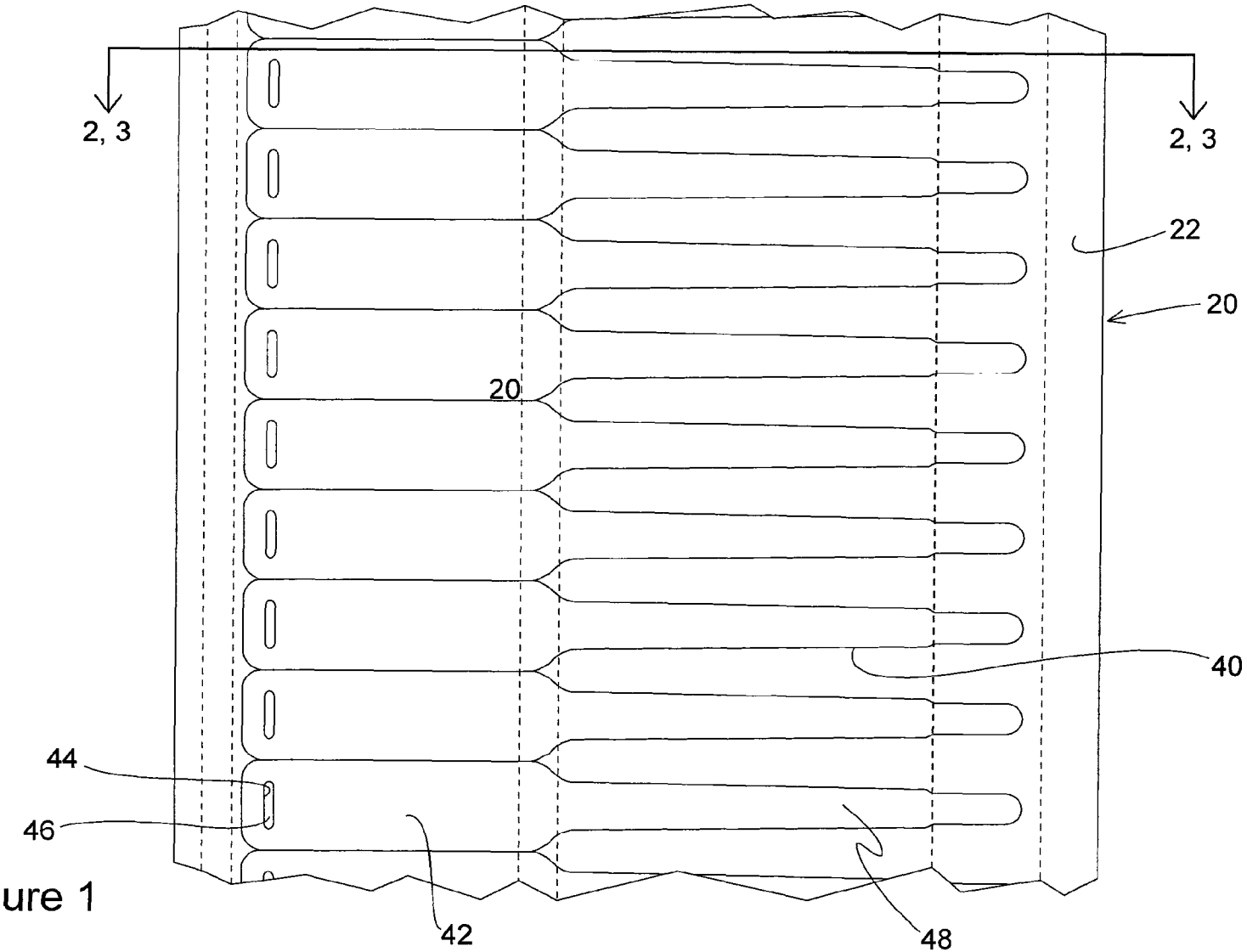
FIG. 1 is a top view of a section of composite web of wristband carriers.
Figure 2:
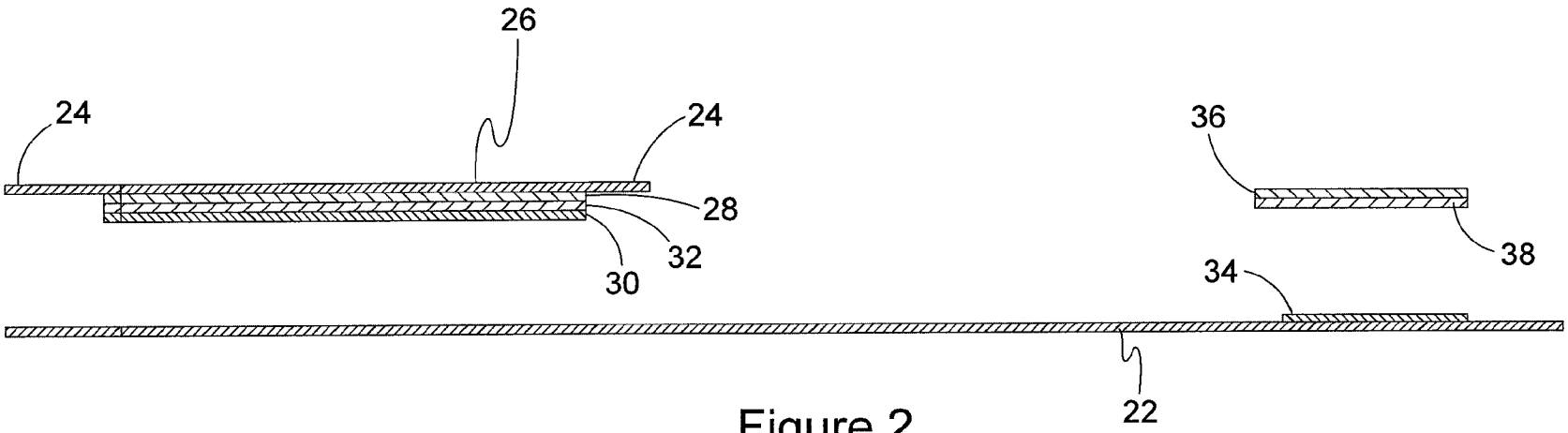
FIG. 2 is an exploded cross-sectional view taken along the lines of 2-2 in FIG. 1 and detailing the various webs comprising the composite web.
Figure 3:
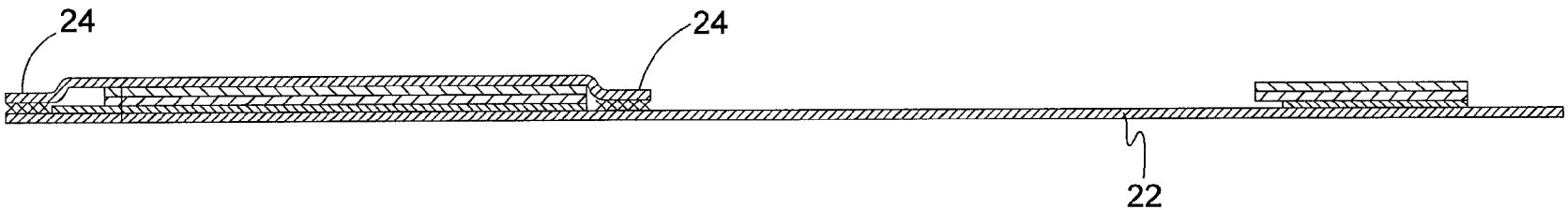
FIG. 3 is a cross-sectional view taken along the lines of 3-3 in FIG. 1 showing how the webs are assembled into the composite web.

As shown in FIG. 1-3, the composite web 20 of the present invention is comprised of a first, full width web 22 to which is adhered, such as by adhesive, welding or the like, a second partial width web 26 along its two longitudinal edges 24, both of which may be made of similar laminate material, such as a transparent 1-2 mil plastic. As the preferred embodiment, the inventor contemplates that the first full width web would be made from a polyester base approximately 2 mil thick and the second web would be made of a polypropylene or polyethelene laminate material approximately 1 mil thick. With this construction, the laminate overlay is "stretchy" and will give to eliminate strain or buckling which might occur with other material choices. If desired, different laminate materials of varying thicknesses may be used to make the webs 22, 26 to suit the particular application or for cost reasons. A layer of adhesive 28, with a covering liner 30 having a layer of release 32 is applied along the length of the second partial width web 26, with the layer of adhesive 28 preferably extending beyond the liner 30 to join the two webs 22, 26 together at their inboard edge 32. Yet another layer of adhesive 34 is applied to the opposite side of the first web 22, and protected with a liner web 36 having a release layer 38. The liner web 36 may extend further inboard than the adhesive layer 34 to provide a "pull tab" for conveniently separating the liner and exposing the underlying adhesive. Each of the liner webs 30, 36 are preferably made of a paper stock.

A die cut 40 is made in the composite web 22, and in the first web 22 defines the full length body of the wristband carrier 42, a plurality of which are thereby cut into the composite web 20 and for ready separation therefrom as needed or desired for use. Die cut 40 extends through all of the webs so that the wristband carrier may be separated by tearing it out of the composite web 22. A second die cut 44 defines the slot 46 for the cinch which is used with the strap portion 48 for attaching the wristband carrier 42 to a wearer's wrist. As is apparent from the Figures, after all the wristband carriers 42 are separated from the composite web 22, there is some waste remaining generally more of which is at the right side of the composite web 22 but a significant part of the web 22 is used. This provides cost savings and helps to reduce the cost for each wristband carrier 42. While the composite web could be formed in a continuous roll, sheets or pages of the web could also be cut into any desired shape or size to contain any desired number of wristband carriers.

In use, a wristband carrier is separated from the web by tearing along die cut 40. Due to the overlapping adhesive layer near the transition between the label receiving portion and the strap, and the lack of any overlapping portion at the slot end of the carrier, the slot end is essentially "hinged" and swings open to expose the liner 30. When it is desired to apply a label to the wristband, the slot end is swung about the hinge, the liner lifted or peeled away from the underlying adhesive, the label is then centered within the label receiving portion and the slot end is then pressed down against the label and the underlying second web 26 to adhere them together, thereby laminating the label in place. For best results, preferably the label is smaller in both dimensions and centered so the than the laminate webs 22, 26 become adhered together surrounding the label, much as in picture frame fashion.

After securing the desired label within the wristband carrier, the wristband may be attached to a wearer much as is the case with other similar wristbands as described in various ones of the patents mentioned above. Simply put, the wristband carrier is wrapped about the wearer's wrist, the strap tail is threaded through the cinch slot, the liner removed exposing the adhesive on the strap tail, the strap looped back onto itself for being adhered with the exposed adhesive.

Figure 4A:
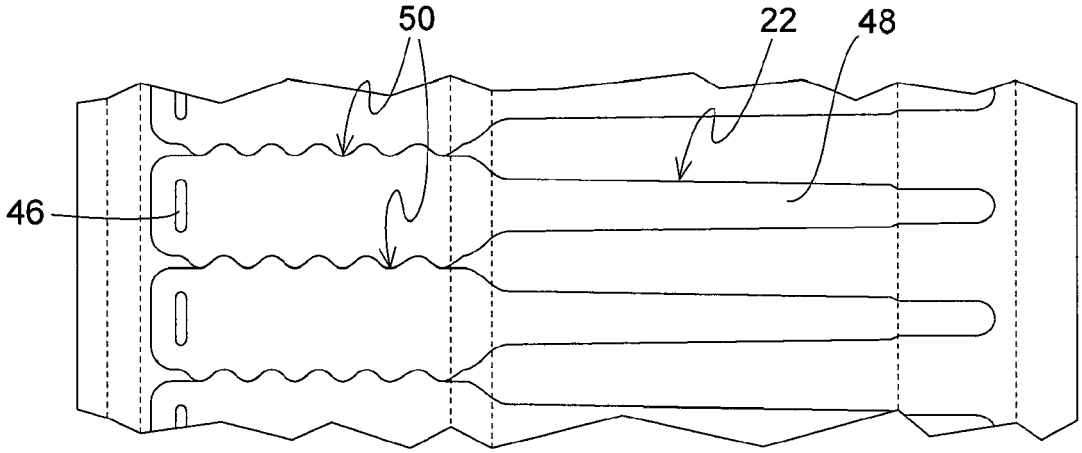
FIGS. 4A-E are top views of the composite web and providing further illustrative examples of wristband carrier designs as might be die cut into the web.
Figure 4B:
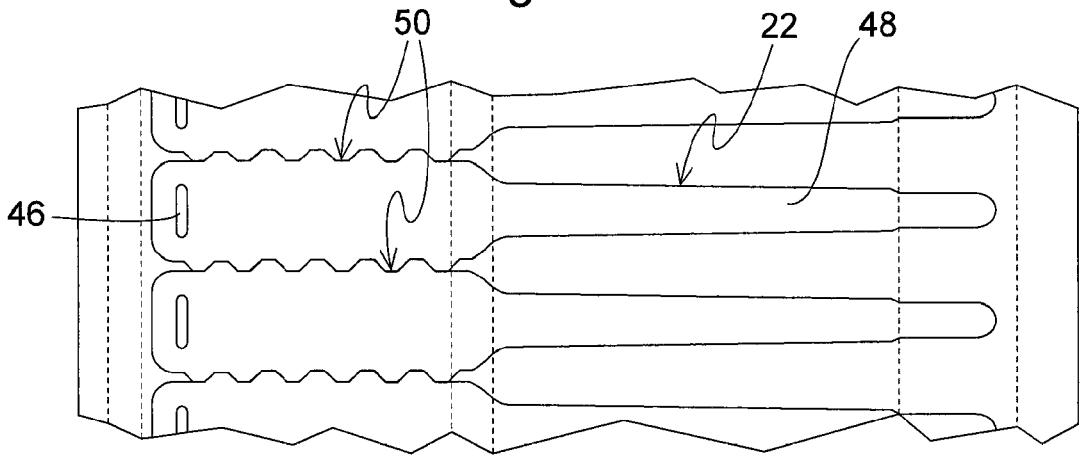
Figure 4C:
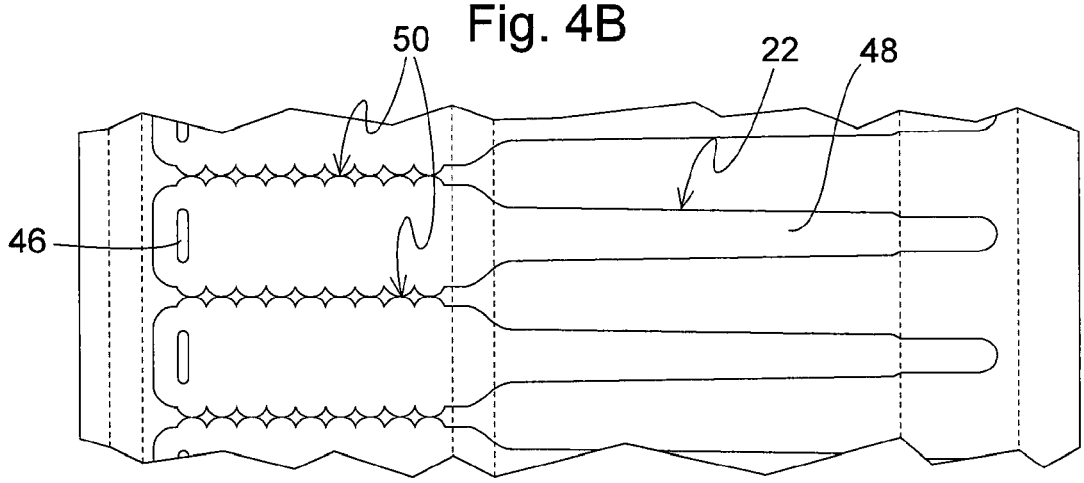
Figure 4D:
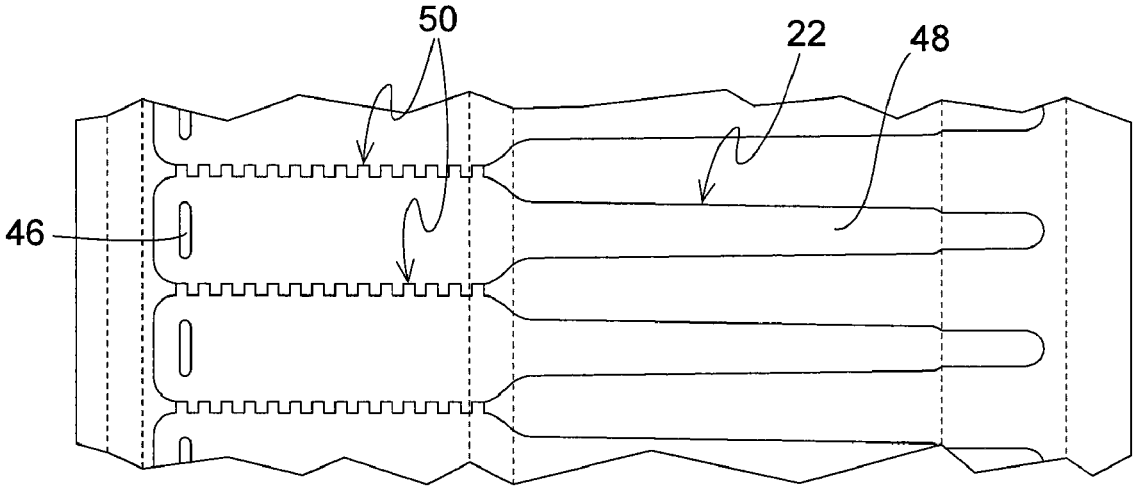
Figure 4E:
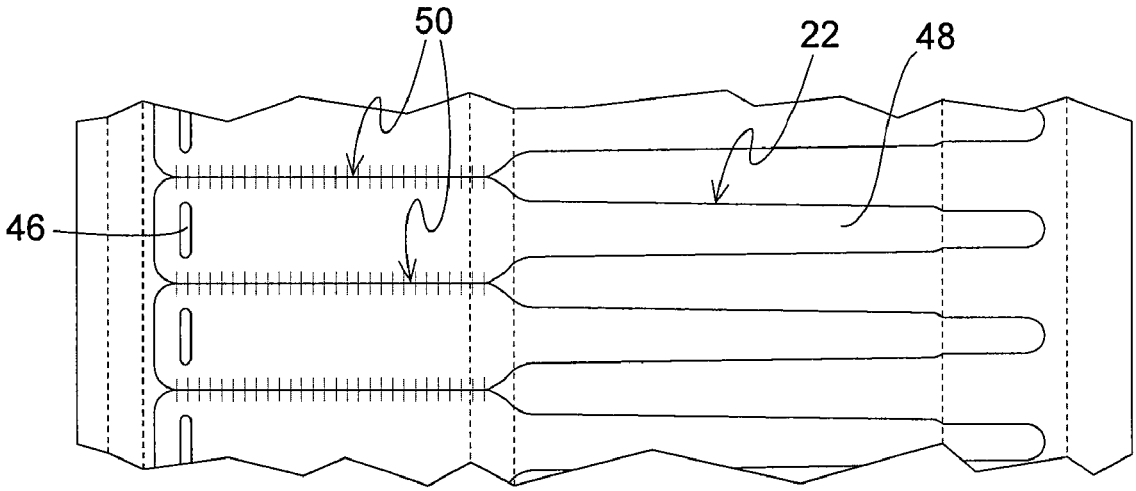

As shown in FIG. 4A-E, a relieved edge or bending yielding feature 50 may be formed by the single die cut 40 separating two adjacent label receiving areas of adjacent wristband carriers and provides an edge that is more comfortable and less prone to abrade or even cut the wearer as the wrist is flexed, or as the wristband is worn. As shown in FIGS. 4A & B, the relieved edge 50 may be generally scalloped in either curvilinear fashion or in a more structured shape such as by emulating pyramids. As shown in FIG. 4C, the relieved edge 50 may be more in a semicircle or rounded shape. As shown in FIG. 4D, the relieved edge 50 may be more of a Greek key or toothed design. And the last illustrative example shown is in FIG. 4E and includes a series of flaps formed by a series of slits. In each of the FIGS. 4A-E only two adjacent wristband carriers are shown although it is to be understood that there is preferably a continuous pattern of them die cut into the composite web much as illustrated in FIG. 1, and that the same or some other relieved edge is preferably formed between each or at least a number of the adjacent carriers.

The foregoing description is intended to be merely illustrative and not limiting in any way of the invention. It is anticipated that those of skill in the art would be aware of variations and additional features of the present invention and that those would be considered as part thereof. For example, various kinds of materials could be used to form the laminate webs, limited solely by design choice. Various kinds of adhesive could be used to the same effect. Instead of using the adhesive layer to adhere the two laminate webs together at their inboard overlapping edges, a welded joint could be formed. Similarly, the outboard overlapping edges could be joined by adhesive instead of being welded together. Other methods and materials could be used to join the webs, only as limited by the design choice made by the form maker.

What is claimed is:

1. A continuous composite web having a plurality of self laminating wristband carriers die cut therein, each of said wristband carriers having a laminating portion formed in a separate, single thin stretchy layer web and adapted to receive and laminate therein an information carrying label, and each of said wristband carriers further comprises a single thin stretchy layer construction having a cinch slot and strap formed by a die cut through said single thin stretchy layer for securing said wristband carrier about a wearer's limb.

2. The composite web of claim 1 further comprising a full width first laminate web, and wherein the laminating portion comprises a separate partial width second laminate web adhered to said first web, a release coated liner web interposed between said first and second laminate webs, and a layer of adhesive applied between said release coated liner web and at least one of said laminate webs.

3. The composite web of claim 2 wherein each of said webs has a plurality of die cuts forming a label receiving portion for each of said wristband carriers, the label receiving portions being aligned with each other and adapted to laminate at least one of said labels.

4. The composite web of claim 3 wherein said second laminate web is adhered at one side of said first web and further comprising a partial width second release coated liner web adhered to said first laminate web opposite said first partial width liner web with a second layer of adhesive applied between said second liner web and said first laminate web.

5. The composite web of claim 4 wherein each of said liner webs is made of a paper stock.

6. The composite web of claim 2 wherein said first laminate web is thicker than the second laminate web.

7. The composite web of claim 6 wherein the first laminate web is approximately 2 mil thick and the second laminate web is approximately 1 mil thick, and the two webs are made of different materials.

8. The composite web of claim 1 wherein at least some of said laminating portions are adjacent, and further comprising a common relieved edge along the adjacent edge between at least some of said adjacent laminating portions.

9. The composite web of claim 8 wherein at least some of said common relieved edges are continuous.

10. The composite web of claim 8 wherein at least some of said common relieved edges are discontinuous.

11. A page cut from the composite web of claim 1 and having a plurality of said self laminating wristband carriers.

12. An assemblage of laminating wristband carriers, said assemblage comprising a first full width single layer stretchy thin laminate web and a second partial width single layer stretchy thin laminate web adhered along one side of said first web, at least one layer of adhesive applied between said first and second webs and a liner substantially covering said adhesive, a die cut in the first web forming a plurality of wristband carriers and a die cut in the second web and liner forming a plurality of laminating portions for said wristband carriers.

13. The assemblage of claim 12 wherein each of said wristband carriers further comprises a cinch slot and strap formed by die cuts in said first web for securing said wristband carrier about a wearer's limb.

14. The assemblage of claim 13 wherein said cinch slot is formed by a die cut adjacent the edge at which the two webs are adhered.

15. The assemblage of claim 14 wherein each of said wristband carriers further comprises a label receiving portion die cut into said first web, and further comprising a relieved edge formed along at least one edge of the label receiving portion.

16. The assemblage of claim 15 wherein at least part of said laminating portion is substantially transparent to permit viewing of a label laminated thereby into said wristband carrier.

17. The assemblage of claim 16 wherein said first web is formed substantially into a page, and the second web is formed substantially into a page having a width less than the first web and the second web extends vertically along an edge of said first web, both of said webs being of substantially the same height.

18. The assemblage of claim 12 wherein the first single stretchy layer thin laminate web is approximately 2 mil thick and the second single stretchy layer thin laminate web is approximately 1 mil thick.

19. The assemblage of claim 18 wherein said first and second webs are made of different materials.

* * * * *